United States Patent [19]

Meijs

[11] 4,199,858

[45] Apr. 29, 1980

[54] METHOD FOR AUTOMATICALLY LUBRICATING PIPE JOINT

[75] Inventor: Franciscus H. Meijs, New Orleans, La.

[73] Assignee: Shell Oil Company, Houston, Tex.

[21] Appl. No.: 870,233

[22] Filed: Jan. 17, 1978

[51] Int. Cl.[2] ..... B23P 3/00; B23P 25/00

[52] U.S. Cl. ..... 29/458; 29/407; 166/243; 222/108

[58] Field of Search ..... 29/407, 460, 458; 166/243; 222/108, 165; 118/317

[56] References Cited

U.S. PATENT DOCUMENTS

| | | | |
|---|---|---|---|
| 2,246,874 | 6/1941 | Burge et al. | 222/108 |
| 2,305,079 | 12/1942 | Heldenbrand | 15/104.04 |
| 2,427,685 | 9/1947 | Midtlyng et al. | 29/407 |
| 2,642,034 | 6/1953 | Griffin et al. | 222/565 X |
| 2,727,383 | 12/1955 | Ross et al. | 29/407 UX |
| 2,760,585 | 8/1956 | Bergeron | 166/243 |
| 4,011,617 | 3/1977 | Toelke et al. | 15/104.04 X |
| 4,014,062 | 3/1977 | Scott et al. | 15/104.04 |

*Primary Examiner*—Charlie T. Moon

[57] ABSTRACT

In a well treating process in which fluid is or will be conveyed to or from a subterranean reservoir through a pipe string containing threaded pipe joints, the avoidance of reservoir permeability impairment is improved by lubricating the pipe joint threads with automatically applied pre-determined amounts of lubricant.

2 Claims, 2 Drawing Figures

METHOD FOR AUTOMATICALLY LUBRICATING PIPE JOINT

BACKGROUND OF THE INVENTION

This invention relates to a well treating process and, more particularly, to a process for lubricating the threads of pipe joints which are interconnected to form a pipe string through which fluid is to be conveyed into or out of a subterranean reservoir. The invention applies to the running in of drill pipe and/or tubing strings to install devices such as packers, cement plugs, screens, liners, gravel packs, injection or production tubing strings, and the like. In such an operation any thread lubricant which is extruded from any pipe joint during any one of the numerous times such pipe strings may be installed and removed is likely to end up as a plugging material lodged within the pores of the reservoir, or in screens, liners, or gravel packs.

As far as applicant is aware, none of the prior procedures involving the interconnecting of threaded pipe joints of pipe strings that are installed after a well has been drill and cased have suggested the use of automatically applied pre-determined amounts of thread lubricants. For example, with respect to thread lubrication, U.S. Pat. No. 2,246,874 describes a table-mounted, foot-operated greasing device for lubricating couplings and the like, with the amount of lubricant applied to each coupling depending on the foot pressure applied by the operator. U.S. Pat. No. 2,642,034 describes a device for greasing and cleaning drill pipe box elements by using spray- or plug-positioned nozzles which are connected to a source of grease under pressure and are arranged so that mud and debris can be displaced by the grease being applied; without describing how much lubricant should be applied. U.S Pat. No. 2,760,585 mentions that the conventional brush applications of grease to pipe joint threads spills much into the wellbore and also fails to properly clean the threads. It describes use of a grease applicator head which is adapted to fit the threads of a box or pin element and is connected, through a trigger means, to a source of pressurized grease; with the system being arranged to effect a cleaning action with old lubricant and debris being displaced by the new lubricant as the operator holds the trigger valve open until he is sure that the entire length of the threaded section has been filled with the new grease.

With respect to pipe cleaning operations, U.S. Pat. No. 2,305,079 describes a manually-operated brush system for removing corrosion products and debris. U.S. Pat. No. 4,011,617 describes a power driven brush system arranged to fit box or pin elements on pipe sections that are racked or stacked or on the rig floor. U.S. Pat. No. 4,014,062 describes a pin thread cleaning unit with power means for rotating adjustable brushes and injecting cleaning solvent.

A recent technical journal article, "*Successful Well Work Demands Rigorous Quality Control*" by J. H. Lybarger, May 23, 1977, Oil & Gas Journal, page 57, cautions that ". . . the minimum pipe thread lubricating techniques for the work string and the production or injection string must be followed". But, the only way suggested is a use of small, paint-brush-type applicators, applying a thin coating over the threads of the pin element, and wiping off any excess dope buildups which may occur after the joints are made up.

In all such prior processes it is up to the operator to decide whether enough lubricant has been applied to each joint—and this inevitably leads to applying excessive amounts to be sure the threads will not gall.

SUMMARY OF THE INVENTION

The present invention relates to a well treating process in which fluid may communicate with a subterranean reservoir through a pipe string containing sections which are interconnected by threaded box and pin elements of pipe joints. A lubricant nozzle-positioning means is sized and shaped to position orifices along a selected portion of the threads of either a box or pin element. The nozzle-positioning means is connected, through a flexible fluid conduit, to a source of lubricant under a pressure sufficient to provide a selected rate of flow of lubricant. A repetitively-actuatible volume-metering means is connected to the fluid conduit so that each actuation permits a selected volume of lubricant to flow toward the nozzle-positioning means. The selected volume of lubricant is preset at a value correlated with the thread surface areas within the joints of the pipe to be connected so that the threads are lubricated and sealed without significant overflow. The pipe string is made up by associatively contacting each box or pin element with the nozzle-positioning means, actuating the fluid-metering means, and mating each lubricated element with the corresponding unlubricated element.

DESCRIPTION OF THE INVENTION

The present invention solves a problem that has existed as long as thread-connected pipe strings have been used but was overlooked by the previous proposals for lubricating the threads of such pipe strings. It avoids the human tendency to over-shoot. In practice, the man handling the brush to apply the pipe lubricant must work under unfavorable conditions. In the usual arrangement, he must extend his hand behind his back to dig a brush into a can of lubricant and then apply it while others are waiting on his operation. Unlubricated threads can gall or stick but overlubricated threads turn smoothly into their seated positions. Where the amount applied to each joint is controlled by the operator, the problem is that his judgment is biased toward applying too much.

Figure 1:
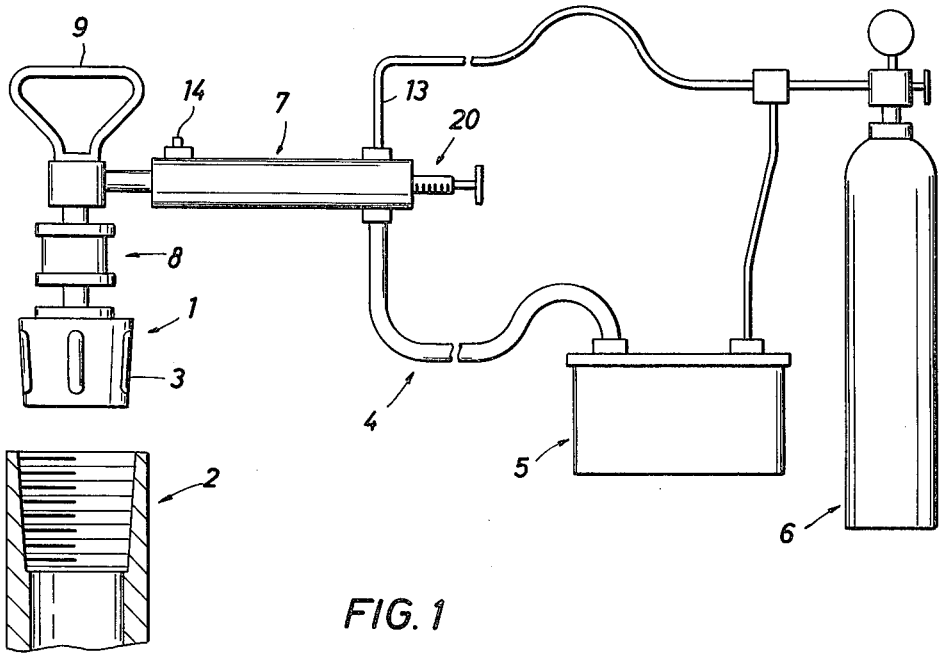
FIG. 1 is a schematic illustration of a system for lubricating the box elements of a pipe string in accordance with the present invenion.

As shown in FIG. 1, a nozzle-positioning means 1 is sized and shaped so that it fits within the threads within a pipe string box element 2 in an associative contact which positions the lubricant nozzle orifices 3 adjacent a selected portion (preferably substantially all) of the threads within a box element. The nozzle-positioning means is connected, through a fluid conduit 4 (which is flexible in at least one portion) to a source of lubricant 5 under enough pressure to cause a flow of the lubricant. The lubricant is driven by a piston pressurized by gas from a compressed-gas container 6. The fluid conduit 4 is also connected to a repetitively actuatible volume-metering means 7. In the embodiment shown, means 7 is actuated by a compression-responsive trigger means 8, which is resiliently-biased to return to its uncompressed state.

In the arrangement shown, the nozzle-positioning means is moved by handle 9 into an associative contact with the threads in box 2 under a pressure sufficient to compress the trigger means 8. The trigger means is connected by a mechanical, hydraulic, or electric means (not shown) to the volume-metering means 7 so that the compression actuates a flow of lubricant toward the nozzle-positioning means and a release of the compressive force returns the volume-metering means to its unactuated state.

Figure 2:
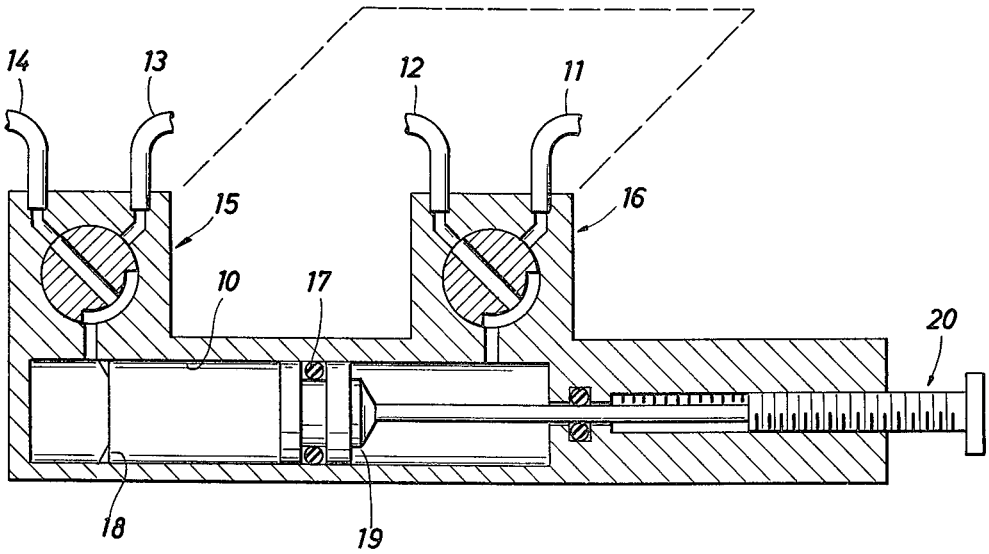
FIG. 2 is a schematic cross-sectional illustration of a flow-metering means suitable for use in the present invention.

FIG. 2 is a more detailed illustration of the flow-metering means 7. A cylindrical chamber 10 is connected to the fluid conduit 4 by means of lubricant inlet tube 11, on the upstream side, and lubricant outlet tube 12, on the downstream side. Cylinder 10 is also connected to the compressed gas chamber 6 through a gas inlet tube 13 and, through a gas vent tube 14, is connected to the atmosphere. The trigger means 8 (shown in FIG. 1) is resiliently urged to remain in the open position and is arranged so that when compressed it actuates a substantially simultaneous operation of switch valves 15 and 16 to open or close passageways through the tubes 11 to 14. A flow of lubricant toward nozzle-positioning means 1 is actuated by opening the lubricant outlet tube 12 and the gas inlet tube 13 while closing the lubricant inlet tube 11 and the gas vent tube 14. This allows the gas pressure to displace the piston 17, within cylinder 10, away from the fixed piston stop 18 and toward the adjustable piston stop 19. The movement of the piston causes the flow of the volume of lubricant displaced by the piston. The volume of lubricant which is permitted to flow can be preset by adjusting the threaded adjusting knob 20 connected to the adjustable piston stop 19.

When the pressure which compressed trigger means 8 is released, that means returns to its open position in a manner that causes a substantially simultaneous switching of valves 15 and 16 to a position allowing the volume-metering means 7 to be refilled with lubricant. The lubricant outlet tube 12 and the gas inlet tube 13 are closed while the lubricant inlet tube 11 and the gas vent tube 14 are opened. The pressure on the lubricant displaces piston 17 toward the fixed stop 18 until a volume of lubricant corresponding to the volume needed to move the piston between the stops 18 and 19 has flowed into the cylinder 10.

The individual devices and techniques that are utilized in the present invention can suitably be devices and techniques known and available to the man skilled in the art. For example, the lubricant nozzle-positioning means 1 can be constructed and arranged as described in U.S. Pat. Nos. 2,642,034 or 2,760,585. In addition, where desirable, the compression-actuated trigger means 8 can be replaced by a manual control lever or trigger of the type described in U.S. Pat. No. 2,760,585, as long as the trigger means is arranged to actuate a volume-metering device, such as the metering device 7. The illustrated pressurized gas container 6, for subjecting the lubricant to a flow inducing pressure and/or actuating the displacements within a volume-metering device such as device 7, can be replaced by pumps or compressors, or the like.

Substantially any repetitive actuatible volume-metering device can be used in place of the illustrated device 7 as long as it can be adjusted to promptly and repetitively deliver a preset selected volume each time it is actuated. Such metering devices can utilize apparatus for compressing a flexible section of fluid conduit, a repetitively operable positive displacement pump, solenoid-operated valves, or the like.

Substantially, any automatically or manually operated trigger or switch means can be used in place of the illustrated compressively actuated trigger means 8, as long as the trigger means is capable of actuating a volume-metering means when the lubricant positioning nozzle-means is in contact with the threads to be lubricated. The triggering or switching action can be initiated by mechanical, hydraulic or electric means.

Although (for convenience) a lubricant nozzle-positioning means adapted to fit within the threads of a pipe joint box element is the only configuration which has been shown, such a nozzle-positioning means can, alternatively, be arranged to fit around the threads of a pin element. Such a pin-treating element is preferably a female member with a triggering device recessed within its body in a location in which it is not contacted until the pin has penetrated far enough to position the orifices along the selected portion of its threads.

In any event, it is important that the size and shape of the lubricant nozzle-positioning means be correlated with those of either the box or pin elements so that, when in associative contact with those elements, the lubricant nozzle outlets are positioning adjacent to the selected portions of the threads. It is generally preferable that such portions comprise substantially all of the threads that contact each other as the tool joint is made up. It is also important that the volume of lubricant that is permitted to flow when the volume-metering means is actuated be sufficient to lubricate and seal along all of such thread surfaces, without overflow. In general, the required amount of lubricant (minimum and maximum) can be determined for the relevant pipe connection by relatively simple tests.

As known to those skilled in the art, the size and shape of the lubricant nozzle-positioning means as well as the needed volume of lubricant will vary rather widely with variations in the size and/or type of pipe string and/or pipe string tool joints to be used. In addition, for example, when a new tubing string is repetitively run into the bore hole the amount of lubricant needed during the first run-in may be relatively small because of the protective grease on the threads of the new pipe but, during the second run-in, the amount needed may be larger due to the wiping-off of the protective grease.

In general, it is preferable that the pipe threads be cleaned with brushes and/or solvents and/or wiped substantially clean prior to being treated in accordance with the present invention. The thread cleaning operations are preferably performed while the pipe string is coming out of the hole or while the string is racked or stacked at the well site.

The thread lubricant and/or sealing compound employed in the present invention can be substantially any which is substantially solid at the ambient conditions at the well site but is adapted to flow at a reasonable rate in response to a moderate pump pressure or displacing fluid pressure. Examples of such lubricants include the Baker Seal thread-sealing compound, product No. 899-20 available from Baker Oil Tool Company. Jet Lube R-T Thread-Coating Lubricant, available from Jet Lube, Inc., API modified thread compound Shell 72732, and the like.

A preferred procedure for determining the amount of lubricant for the threads of a given pipe joint in a given situation is based on the sealing effects of a thread lubricant. Such effects are well known. For example, the sealing mechanisms of commonly used types of threaded tubular connections is discussed in a Journal of Petroleum Technology article, March 1967, page 337, "New Technology For Improved Tubular Connection Performance", by P. D. Weiner and F. D. Sewell. The authors indicate that "Obtaining pressure seals in all connections except those employing supplementary resilient Teflon seals requires adequate make-up to move mating pin and box surfaces together with sufficient force to establish a bearing pressure between surfaces exceeding the differential pressure across the connection." And, "Connection make-up torque depends primarily on the friction between the mating pin and box threads which, for clean connections, is largely a function of the type of thread compound employed". The authors show that employing different types of thread compounds can cause connection make-up torque variations of up to 500 percent.

It is also known that, by applying appropriate thread lubricants and connection make-up torques and techniques, leak-free connections can be reliably obtained. In addition, relatively convenient and accurate pipe joint leak testing devices and services are available for determining the capability of the connected joints to resist pressure differentials within their strength capabilities. Procedures and devices for leak testing pipe joints with hydraulic pressures which are applied externally or internally are described in U.S. Pat. Nos. such as 3,371,521 or 3,653,254 and the prior publications to which they refer.

Thus, for a given pipe string in which the joints are to be lubricated and torqued to extents suitable for the specific conditions of pressure, temperature and fluid corrosivity, etc. in the well in which the string is to be installed, tests can be readily be made of the amounts of the thread lubricant or compound to be used. At least two tests are made on at least one joint of the pipe string. In each test at least one joint is connected after lubricating the threads of its pin or box with a preselected amount of lubricant flowed through the volume-metering means of the present invention. In at least one test the joint is disconnected to determine whether lubricant was extruded from between the threads. In at least one test in which the applied amount of lubricant is insufficient to cause such extrusion, the joint is leak-tested to determine whether its connection under the torque to be applied is fluid-tight in respect to the pressure differential to be encountered. The lubricant volume-metering means is then preset to apply a so-determined amount of lubricant which lubricates and seals without extrusion. As will be apparent to those skilled in the art, such values can readily be predetermined with respect to an equivalent pipe string to be used in an equivalent situation, for example, in a well previously completed in the same field.

I claim:

1. In a well-treating process in which fluid is conveyed to or from a subterranean reservoir through a pipe string containing threaded pipe joints, an improved procedure for avoiding impairment in the permeability of the reservoir which comprises:

cleaning the threads of the pipe joint elements to the extent required to ensure a substantial freedom from contaminated lubricants or solid debris;

arranging a lubricant nozzle-positioning means so that it positions lubricating orifices along a selected portion of the threads of either the box or pin elements of the pipe to be used each time the nozzle-positioning means is brought into associative contact with those elements;

connecting the lubricating orifices, through a fluid conduit having sufficient flexibility to permit the thread-contacting movements of the nozzle-positioning means, to a source of lubricant under a pressure capable of causing a selected rate of flow of lubricant;

connecting a repetitively-actuatible volume-metering means to the fluid conduit so that each actuation of the metering means permits a selected volume of lubricant to flow toward the lubricating orifices;

adjusting the volume-metering means to preset said selected amount of lubricant that is allowed to flow at a volume correlated with the thread surface area within the pipe joints to be connected to provide a volume that is capable of lubricating and sealing substantially all of that area without significant overflow;

said lubricant that is allowed to flow being determined by tests conducted on a pipe string at least equivalent to the one being installed by (1) connecting at least one joint in which the pin or box is lubricated with a preselected amount of lubricant flowed through the volume-metering means, (2) disconnecting at least one so-connected joint and determingin whether lubricant was extruded from between the threads, (3) leak testing at least one so-connected joint in which (a) the amount of lubricant applied is less than enough to cause extrusion from between the threads, (b) the joint is torqued to an extent at least substantially equalling that to be employed in making up the pipe string, and (c) the leak-testing pressure differential at least substantially equals that likely to be encountered in a well in which the pipe string is being installed, and (4) selecting as the amount of lubricant to be allowed to flow through the volume-metering means an amount which, in the condition of said tests, is sufficient to lubricate and seal the pipe joint threads without extrusion; and, making up the pipe string by associateively contacting each box or pin element with the nozzle-positioning means and actuating the volume-metering means and subsequently mating each lubricated element with the corresponding unlubricated element.

2. A well pipe string thread-lubricating process which comprises:

arranging a lubricant nozzle-positioning means so that it positions lubricating orifices along a selected portion of threads of either the box or pin elements of the pipe to be used each time the nozzle-positioning means is brought into associative contact with those elements;

connecting the lubricating orifices, through a fluid conduit having sufficient flexibility to permit the thread-contacting movements of the nozzle-positioning means, to a source of lubricant under a pressure capable of causing a selected rate of flow of lubricant;

connecting a repetitively-actuatible volume-metering means to the fluid conduit so that each actuation of the metering means premits a selected volume of lubricant to flow toward the lubricating orifices;

adjusting the volume-metering means to present said selected amount of lubricant that is allowed to flow at a volume correlated with the thread surface area within the pipe joints to be connected to provide a volume that is capable of lubricating and sealing substantially all of that area without significant overflow;

said amount of lubricant that is allowed to flow being determined by tests conducted on a pipe string at least equivalent to the one being installed by (1) connecting at least one joint in which the pin or box is lubricated with a preselected amount of lubricant flowed through the volume-metering means, (2) disconnecting at least one so-connected joint and determining whether lubricant was extruded from between the threads, (3) leak testing at least one so-connected joint in which (a) the amount of lubricant applied is less than enought to cause extrusion from between the threads, (b) the joint is torqued to an extent at least substantially equalling that to be employed in making up the pipe string, and (c) the leak-testing pressure differential at least substantially equals that likely to be encountered in a well in which the pipe string is being installed, and (4) selecting as the amount of lubricant to be allowed to flow through the volume-metering means an amount which, in the condition of said tests, is sufficient to lubricate and seal the pipe joint threads without extrusion; and, making up the pipe string by associatively contacting each box or pin element with the nozzle-positioning means and actuating the volume-metering means and subsequently mating each lubricated element with the corresponding unlubricated element.

* * * * *